US012590460B2

(12) United States Patent
Buley et al.

(10) Patent No.: US 12,590,460 B2
(45) Date of Patent: Mar. 31, 2026

(54) REINFORCING BAR CAGE CONNECTORS AND METHODS OF CONSTRUCTING REINFORCING BAR CAGES

(71) Applicants: Gloria M. Buley, Whitewater, WI (US); Travis C. Buley, Whitewater, WI (US)

(72) Inventors: Gloria M. Buley, Whitewater, WI (US); Travis C. Buley, Whitewater, WI (US)

( * ) Notice: Subject to any disclaimer, the term of this patent is extended or adjusted under 35 U.S.C. 154(b) by 176 days.

(21) Appl. No.: 18/239,627

(22) Filed: Aug. 29, 2023

(65) Prior Publication Data

US 2025/0075500 A1 Mar. 6, 2025

(51) Int. Cl.
*E04C 5/16* (2006.01)
*E04C 5/06* (2006.01)

(52) U.S. Cl.
CPC ..... *E04C 5/167* (2013.01); *E04C 5/0604* (2013.01)

(58) Field of Classification Search
CPC ..... E04C 5/167; E04C 5/168; E04C 5/0604; E04C 5/0609
See application file for complete search history.

(56) References Cited

U.S. PATENT DOCUMENTS 1,684,051 A * 9/1928 Anderson ..... E04C 5/167 52/719
2,216,886 A 10/1940 Langelier
4,463,538 A * 8/1984 Dragunas ..... E04C 5/167 52/687
5,533,239 A * 7/1996 Gall ..... E04C 5/167 24/339
6,622,352 B2 * 9/2003 Herron ..... E04C 5/167 24/336
6,898,915 B2 * 5/2005 Hancock ..... E04C 5/167 52/687

(Continued)

FOREIGN PATENT DOCUMENTS

GB 508002 A * 6/1939
GB 1160032 A * 7/1969

(Continued)

OTHER PUBLICATIONS

PCT International Search Report and Written Opinion of the International Searching Authority for Application No. PCT/US2023/086383 mailed May 29, 2024, 18 pages.

*Primary Examiner* — Adriana Figueroa
(74) *Attorney, Agent, or Firm* — McAndrews, Held & Malloy, Ltd.

(57) ABSTRACT

A rebar cage includes a rebar guide, a rebar rod, and a rebar cage connector. The rebar cage connector includes front and rear sides, a base portion having top and bottom ends, upper and lower tabs extending at angles from the top and bottom ends of the base portion, and a hook portion. The upper and lower tabs respectively include upper and lower tab openings extending through the upper and lower tabs and through the top and bottom ends of the base portion. The hook portion extends from a first end at the base portion at the rear side and curls up towards the upper tab at a second end. The upper tab opening and the lower tab opening receive the rebar rod on the front side of the rebar cage connector. The hook portion receives the rebar guide on the rear side of the rebar cage connector.

20 Claims, 7 Drawing Sheets

(56) References Cited

U.S. PATENT DOCUMENTS

| | | | | |
|---|---|---|---|---|
| 8,935,900 | B2 * | 1/2015 | Holthusen | E04C 5/168<br>52/707 |
| 10,302,110 | B2 * | 5/2019 | Johnson | F16B 7/0493 |
| 2002/0104286 | A1 | 8/2002 | Gregel et al. | |
| 2003/0051319 | A1 | 3/2003 | Herron | |
| 2008/0072414 | A1 | 3/2008 | Buley | |

FOREIGN PATENT DOCUMENTS

| | | | | |
|---|---|---|---|---|
| KR | 200550106778 | A | 11/2005 | |
| KR | 100657205 | B1 | 12/2006 | |
| WO | 0045008 | | 8/2000 | |
| WO | WO-0126974 | A2 * | 4/2001 | E04C 5/0604 |

* cited by examiner

REINFORCING BAR CAGE CONNECTORS AND METHODS OF CONSTRUCTING REINFORCING BAR CAGES

FIELD

The present disclosure relates to fabrication of concrete elements that include reinforcing bar cages. More specifically, the present disclosure relates to reinforcing bar cage connectors operable to secure reinforcing bar cages used in fabrication of concrete elements, and methods of constructing reinforcing bar cages used in fabrication of concrete elements.

BACKGROUND

Concrete is a building material made from the combination of aggregate and a cement binder. A common form of concrete consists of Portland cement, mineral aggregates (for example, gravel and sand) and water. After mixing, the water reacts with the cement in a chemical process known as hydration, during which the water is absorbed by the cement, which hardens, binding the aggregates together and eventually creating a stone-like material. Concrete is used, for example, in pavement, building structures, foundations, roads, and bases for gates, fences and poles. Concrete is also used, for example, in concrete columns used in construction known as footings.

Concrete has high compressive strength, but low tensile strength. In other words, concrete can withstand axially directed pushing forces, but cannot withstand axially directed pulling forces. As a result, concrete elements subjected to tensile stresses are often reinforced with steel bars, known as reinforcing bar or rebar, which can aid in carrying tensile loads. Rebar is often formed from mild steel, and given ridges for better frictional adhesion to the concrete.

In practice, a reinforcing cage can be constructed out of rebar. A reinforcing cage can be constructed out of multiple pieces of rebar that are maintained relative to each other in conjunction with specific design requirements. Some examples of items that can influence the design requirements of a reinforcing cage include: the type of structure that is being fabricated, the size and weight of the structure, and the bearing capacity of the soil upon which the structure will rest.

Once a reinforcing cage is constructed, it can be inserted into a mold that can receive concrete. In one example, a mold can be a tube made of cardboard or other fibrous material. Examples of such tubes are the Sonotube® made by Sonoco Products Company and the Quik-Tube® made by the QUIKRETE® Companies.

Once a reinforcing cage is constructed and inserted into a mold, mixed concrete can be poured into the tube and allowed to harden. The result is a concrete element that includes a reinforcing cage that, as described above, can aid in carrying tensile loads.

Unfortunately, constructing a reinforcing cage can be time-consuming and cumbersome. For example, one method used to construct reinforcing cages utilizes pieces of wire to connect pieces of rebar in a desired configuration. However, one problem with such a method is that the resulting reinforcing cage is not very durable and can fall apart or lose desired dimensions when being moved or inserted into a mold. In another example, pieces of rebar that make up a reinforcing guide can be welded together. Such reinforcing guides are more durable than the ones held together by wires, however, they can be costly in terms of materials and labor.

Further limitations and disadvantages of conventional and traditional approaches will become apparent to one of skill in the art, through comparison of such systems with some aspects of the present disclosure as set forth in the remainder of the present application.

SUMMARY

Certain embodiments of the present technology provide reinforcing bar cage connectors and methods of constructing reinforcing bar cages, substantially as shown in and/or described in connection with at least one of the figures.

These and other advantages, aspects and novel features of the present disclosure, as well as details of an illustrated embodiment thereof, will be more fully understood from the following description and drawings.

DETAILED DESCRIPTION

Figure 1:
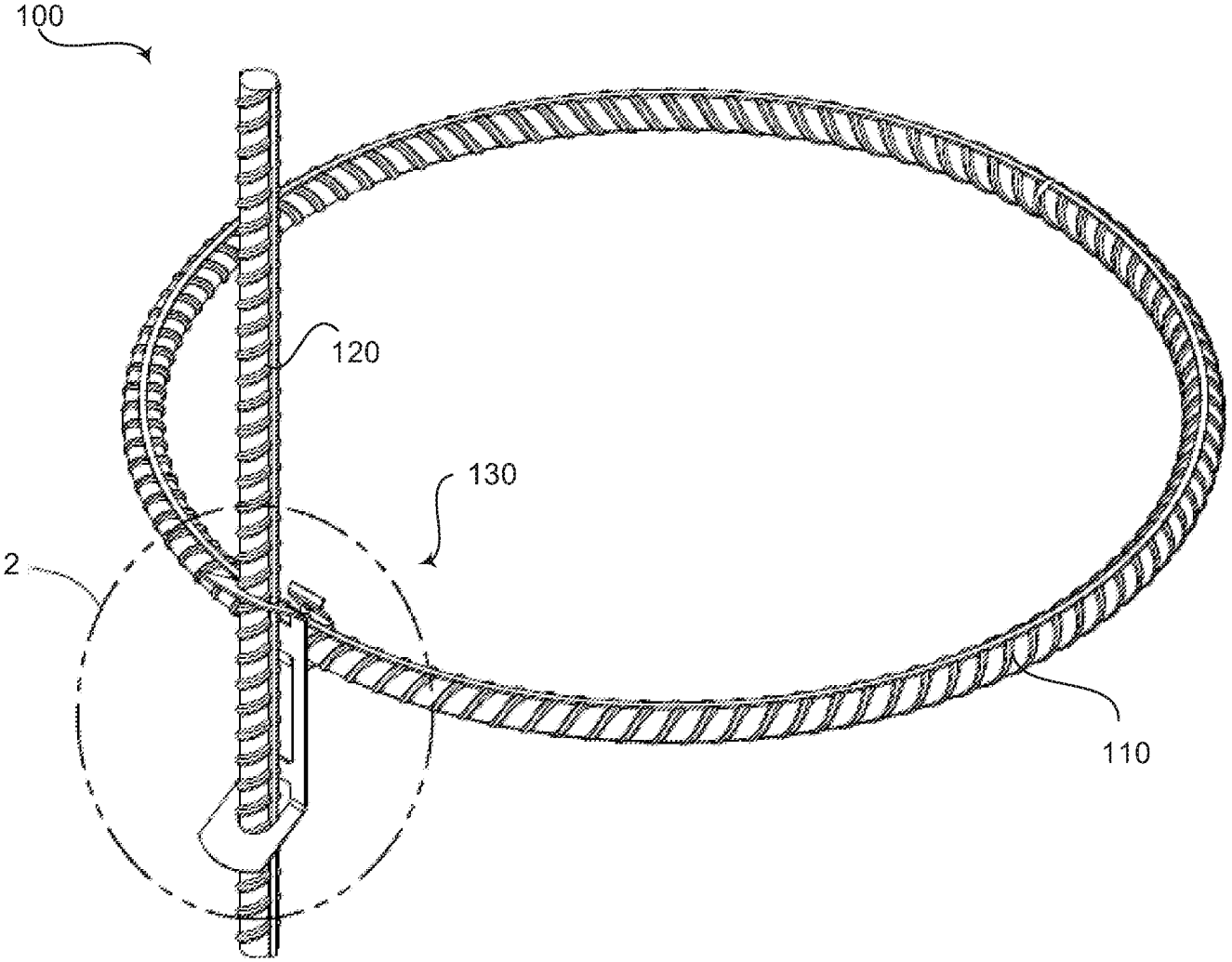
FIG. 1 depicts a front, top perspective view of an exemplary reinforcing bar cage having a reinforcing bar guide securely coupled to a reinforcing bar rod by a reinforcing bar cage connector, in accordance with various embodiments.

Embodiments of the present technology provide reinforcing bar cage connectors that quickly and securely fasten reinforcing bar guides to reinforcing bar rods to construct a reinforcing bar cage.

The foregoing summary, as well as the following detailed description of certain embodiments will be better understood when read in conjunction with the appended drawings. It should be understood that the various embodiments are not limited to the arrangements and instrumentality shown in the drawings. It should also be understood that the embodiments may be combined, or that other embodiments may be utilized and that structural changes may be made without departing from the scope of the various embodiments of the present disclosure. The following detailed description is, therefore, not to be taken in a limiting sense.

As used herein, an element or step recited in the singular and proceeded with the word "a" or "an" should be understood as not excluding the plural of the elements or steps, unless such exclusion is explicitly stated. Furthermore, references to "an embodiment," "one embodiment," "a representative embodiment," "an exemplary embodiment,"

"various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

It will be understood that, although the terms first, second, etc. may be used herein to describe various elements, these elements should not be limited by these terms. These terms are only used to distinguish one element from another element. Thus, for example, a first element, a first component, or a first portion discussed below could be termed a second element, a second component, or a second portion without departing from the teachings of the present disclosure. Similarly, various spatial terms, such as "top," "bottom," "upper," "lower," "inner," "outer," "front," "rear," "back," "side," and the like, may be used in distinguishing one element from another element in a relative manner. It should be understood, however, that components may be oriented in different manners, for example a reinforcing bar cage connector may be turned sideways so that its "top" surface is facing horizontally and its "side" surface is facing vertically, without departing from the teachings of the present disclosure.

Figure 2:
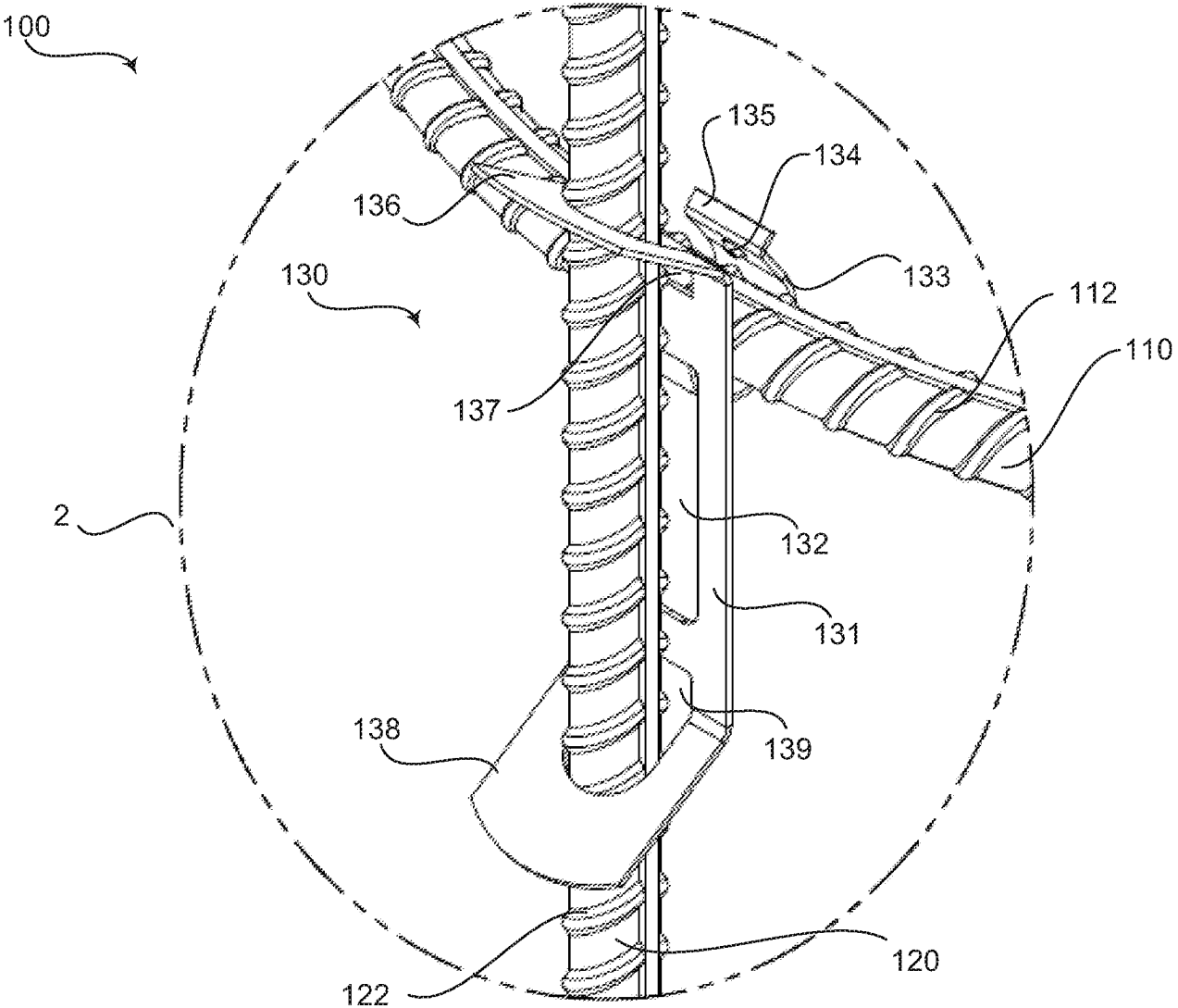
FIG. 2 depicts an enlarged view of the identified portion of FIG. 1, in accordance with various embodiments.
Figure 3:
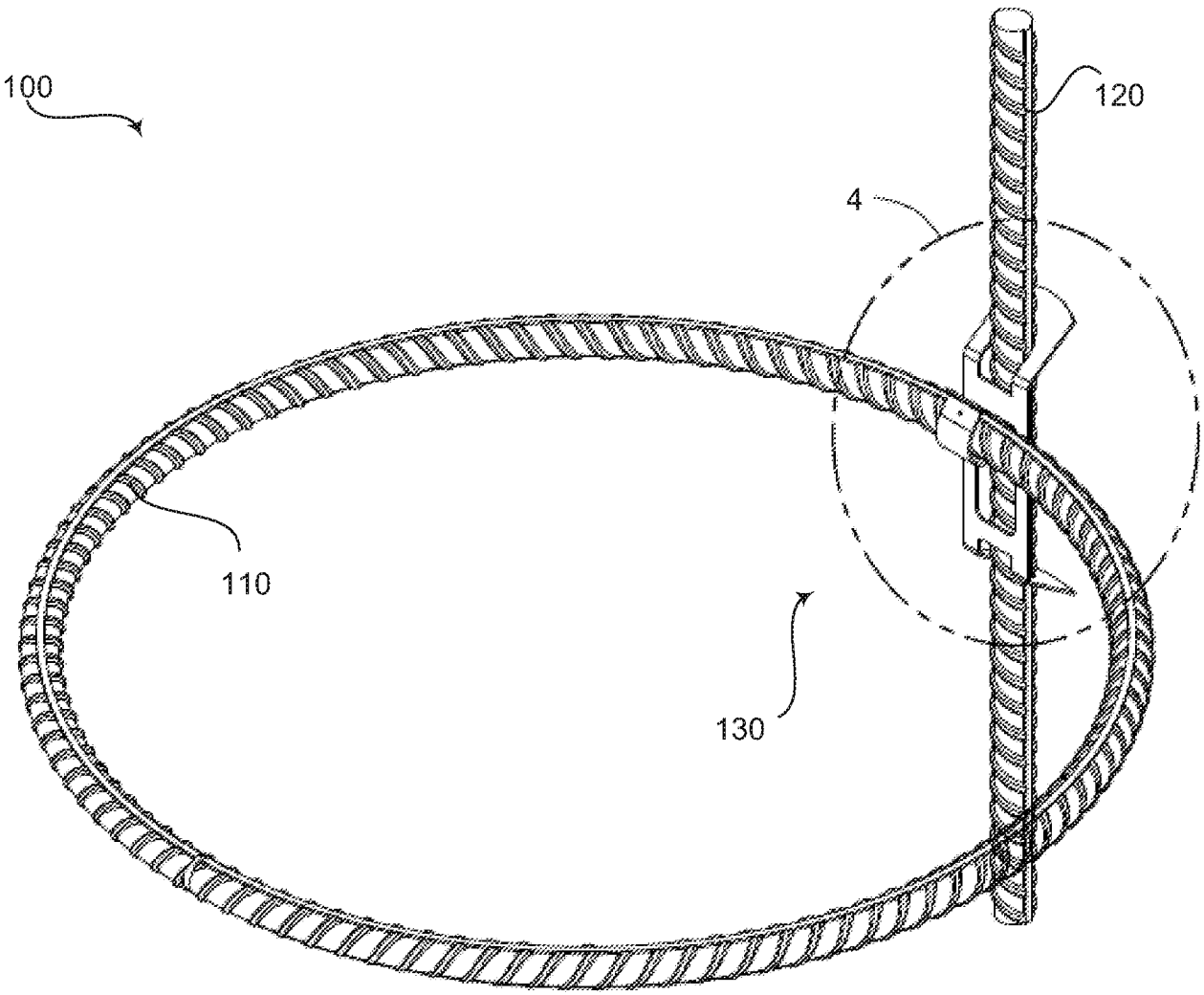
FIG. 3 depicts a rear, top perspective view of an exemplary reinforcing bar cage having a reinforcing bar guide securely coupled to a reinforcing bar rod by a reinforcing bar cage connector, in accordance with various embodiments.
Figure 4:
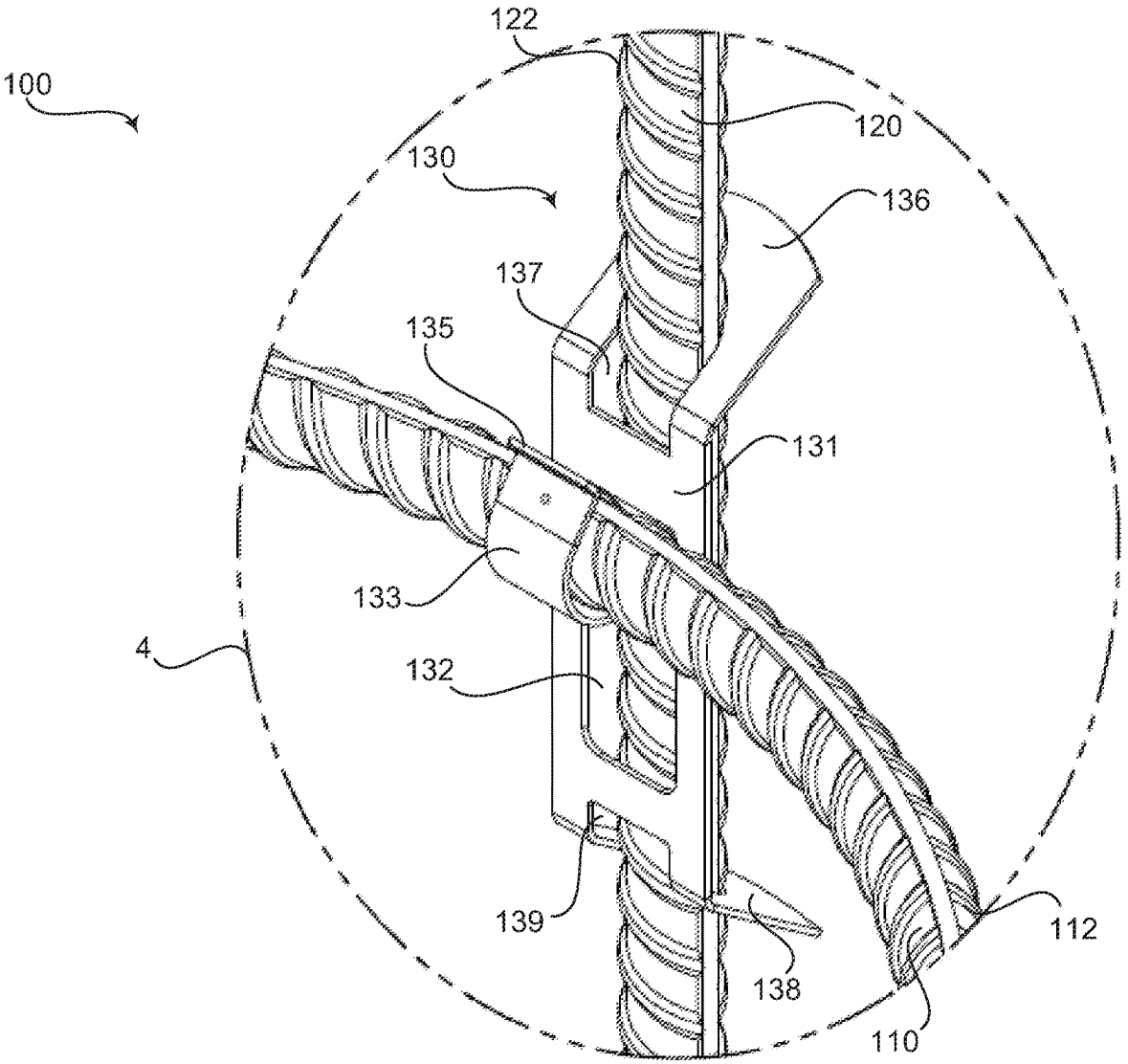
FIG. 4 depicts an enlarged view of the identified portion of FIG. 3, in accordance with various embodiments.

FIG. 1 depicts a front, top perspective view of an exemplary reinforcing bar cage 100 having a reinforcing bar guide 110 securely coupled to a reinforcing bar rod 120 by a reinforcing bar cage connector 130, in accordance with various embodiments. FIG. 2 depicts an enlarged view of the identified portion 2 of FIG. 1, in accordance with various embodiments. FIG. 3 depicts a rear, top perspective view of an exemplary reinforcing bar cage 100 having a reinforcing bar guide 110 securely coupled to a reinforcing bar rod 120 by a reinforcing bar cage connector 130, in accordance with various embodiments. FIG. 4 depicts an enlarged view of the identified portion 4 of FIG. 3, in accordance with various embodiments.

Referring to FIGS. 1-4, a reinforcing bar cage 100 is shown. The reinforcing bar cage 100 comprises a reinforcing bar guide 110, a reinforcing bar rod 120, and a reinforcing bar cage connector 130 securely fastening the reinforcing bar guide 110 to the reinforcing bar rod 120. As used herein, the term "reinforcing bar" is also referred to as "rebar" (e.g., rebar cage 100, rebar guide 110, rebar rod 120, rebar cage connector 130, and the like). Although the rebar cage 100 is shown having one rebar rod 120 attached to the rebar guide 110 by the rebar cage connector 130, any suitable number of rebar rods 120 may be fastened to rebar guide 110 by a corresponding number of rebar cage connectors 130. The rebar rods 120 may be evenly spaced or unevenly spaced around the rebar guide 110. Furthermore, any suitable number of rebar guides 110 may be secured to each rebar rod 120 by a corresponding number of rebar cage connectors 130. The rebar guides 110 may be evenly spaced or unevenly spaced along one or more of the rebar rods 120. For example, three (3) rebar guides 110 may be secured to four (4) rebar rods 120 using twelve (12) rebar cage connectors 130 to construct the rebar cage 100. As another example, five (5) rebar guides 110 may be secured to three (3) rebar rods 120 using fifteen (15) rebar cage connectors 130 to construct the rebar cage 100.

Although the rebar rod 120 is shown connected by the rebar cage connector 130 on an outside of the rebar guide 110, in various embodiments, the rebar rod 120 may additionally or alternatively be coupled by the rebar cage connector 130 to an inside of the rebar guide 110. Although the rebar guide 110 is illustrated as having an oval shape, in various embodiments, the rebar guide 110 may be any suitable shape, such as circular, square, triangular, rectangular, trapezoidal, or the like. For example, in other embodiments, the rebar guide 110 can be a straight element or an element with any number of bends or curves. As an example, in other embodiments, the shape of the rebar guide 110 can vary depending on the design requirements of the rebar guide 110. Although the rebar guide 110 and rebar rod 120 are both preferably made of rebar (i.e., reinforcing bar), in other embodiments, one or both of the rebar guide 110 and rebar rod 120 may not be made of rebar. For example, the rebar guide 110 and/or rebar rod 120 may be made of any strong and durable material. In various embodiments, the rebar cage connector 130 may be made of metal, such as hot dipped galvanized spring steel, high carbon steel, and/or any suitable material. In an exemplary embodiment, the rebar cage connector 130 may be coated with a rust-resistant material to increase durability and lifespan.

Figure 5:
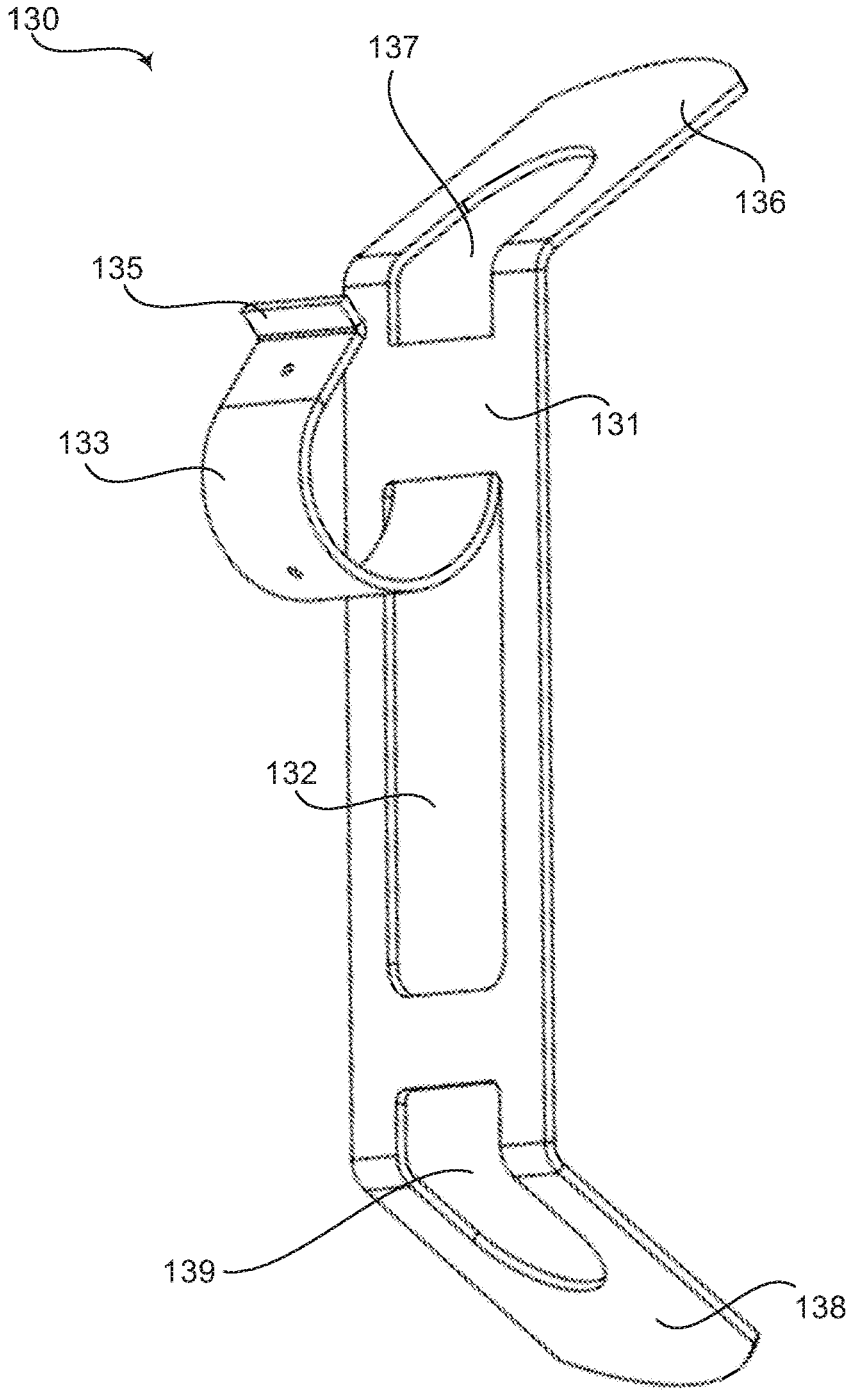
FIG. 5 depicts a rear, side perspective view of exemplary reinforcing bar cage connector, in accordance with various embodiments.
Figure 6:
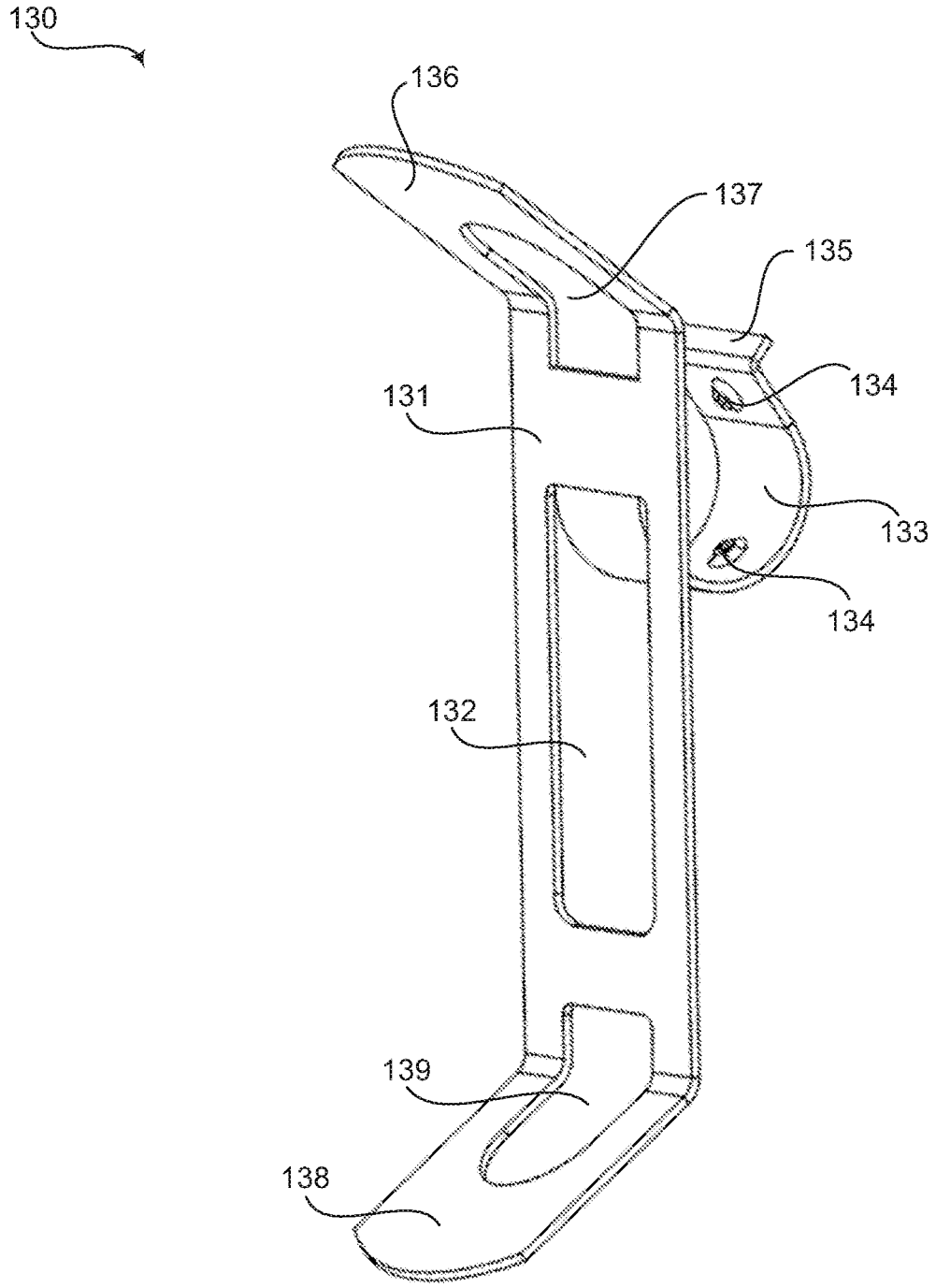
FIG. 6 depicts a front, side perspective view of exemplary reinforcing bar cage connector, in accordance with various embodiments.

The rebar cage 100 is constructed by securing the rebar guide 110 to the rebar rod 120 via the rebar cage connector 130. FIG. 5 depicts a rear, side perspective view of exemplary reinforcing bar cage connector 130, in accordance with various embodiments. FIG. 6 depicts a front, side perspective view of exemplary reinforcing bar cage connector 130, in accordance with various embodiments. Referring to FIGS. 1-6, the rebar cage connector 130 comprises a base portion 131, a first (i.e., upper) tab 136, a second (i.e., lower) tab 138, and a hook portion 133. The first tab 136 extends from a first (i.e., top) end of the base portion 131 in a first direction forming a first obtuse angle between front sides of the base portion 131 and upper tab 136. The second tab 138 extends from a second (i.e., bottom) end of the base portion 131 in a second direction forming a second obtuse angle between front sides of the base portion 131 and lower tab 138. In various embodiment, the first and second obtuse angles may be the same angle or substantially the same angle (i.e., within 10 degrees). In an exemplary embodiment, the first and second directions are both angled away from the base portion 131 and towards a front side of the rebar cage connector 130.

The upper tab 136 comprises an upper tab opening 137. The upper tab opening 137 is provided through the upper tab 136 and through the top end portion of the base portion 131. The upper tab opening 137 extends between a central location of the upper tab 136 and the top end portion of the base portion 131. The lower tab 138 comprises a lower tab opening 139. The lower tab opening 139 is provided through the lower tab 138 and through the bottom end portion of the base portion 131. The lower tab opening 139 extends between a central location of the lower tab 138 and the bottom end portion of the base portion 131.

The upper tab opening 137 and lower tab opening 139 are configured to receive a same rebar rod 120 that extends through both openings 137, 139. In a representative embodiment, a rear side of the upper tab 136 and a rear side of the lower tab 138 are configured to simultaneously receive a compressive force to slightly bend the ends of the tabs 136, 138 towards each other, which slightly enlarges a size of the openings 137, 139 along a longitudinal axis through the openings 137, 139, and allows the rebar cage connector 130 to slide along the rebar rod 120 to a desired position on the rebar rod 120. For example, a user may use a thumb and finger to press the upper 136 and lower 138 tabs towards each other while sliding the rebar cage connector 130 along the rebar rod 120 to the desired position. The compressive force is released once the rebar cage connector 130 is positioned on the rebar rod 120. The end portions of the openings 137, 139 at the central locations of the tabs 136, 138 and at the top and bottom end portions of the base portion 131 are configured to engage a deformation pattern 122 on the rebar rod 120 to provide a strong and stable connection once the compressive force is released from the upper 136 and lower 138 tabs. The deformation pattern 122 is protrusions (e.g., ribs or the like) on the rebar rod 120, which may be a helical pattern, V-shaped pattern, swirls, or any suitable pattern.

In various embodiments, the base portion 131 comprises a curvature. For example, a rear side (i.e., from which the hook portion 133 extends) of the base portion 131 may be slightly concave and a front side (i.e., opposite the hook portion 133) of the base portion 131 may be slightly convex. The compressive force provided on the rear sides of the upper 136 and lower 138 tabs may straighten and/or otherwise reduce an amount of curvature of the base portion 131, such that a size of the openings 137, 139 along a longitudinal axis through the openings 137, 139 is increased to allow the rebar cage connector 130 and rebar rod 120 to slide with respect to each other. The curvature of the base portion 131 biases the uppermost end of the upper tab 136 and the lowermost end of the lower tab 138 away from each other such that the size of the openings 137, 139 along the longitudinal axis through the openings 137, 139 is decreased when the compressive force is released. The bias force provided by the curvature of the base portion 131 increases the force of the engagement between the two end portions of each of the openings 137, 139 and the deformation pattern 122 on the rebar rod 120 to provide the secure connection of the rebar cage connector 130 on the rebar rod 120.

The hook portion 133 of the rebar cage connector 130 extends from a rear side of the base portion 131 of the rebar cage connector 130 and curls up towards the upper tab 136. In various embodiments, the hook portion 133 may be formed from material of the base portion 131, which leaves a base opening 132 in the base portion 131. The hook portion 133 comprises a first end attached and/or integrated with the base portion 131 and a second end opposite the first end. The second end may comprise a flared end portion 135 configured to assist in receiving a rebar guide 110. In various embodiments, an inside surface of the hook portion 133 may comprise punch grips 137. The punch grips 137 are protrusions (e.g., dimples, indents, or the like) configured to engage a deformation pattern 112 on the rebar guide 110 to provide a strong and stable connection. The deformation pattern 112 is protrusions (e.g., ribs or the like) on the rebar guide 110, which may be a helical pattern, V-shaped pattern, swirls, or any suitable pattern.

In operation, the rebar guide 110 may be pressed between the flared end 135 of the hook portion and the rear side of the base portion 131. The pressure pushes the flared end 135 away from the rear side of the base portion 131 such that the rebar guide 110 passes through the opening between the flared end 135 and the rear side of the base portion 131 and snaps into the hook portion 133. The flared end 135 is biased towards the rear side of the base portion 131 such that the flared end moves back towards the rear side of the base portion 131 once the rebar guide 110 moves through the opening between the flared end 135 and the rear side of the base portion 131 and into the hook portion 133. The punch grips 137 engage the deformation pattern 112 on the rebar guide 110 once the rebar guide enters the hook portion 133 to provide the secure connection between the hook portion 133 of the rebar cage connector 130 and the rebar guide 110. The inside surface of the hook portion 133 and the rear side of the base portion are configured to cover a majority of a circumference of the rebar guide 110 when the rebar guide is positioned within the hook portion 133 of the rebar cage connector 130.

As shown in FIGS. 1-4, the hook portion 133 is configured to engage and secure a horizontal rebar guide 110 on a first (i.e. rear) side of the rebar cage connector 130 while the openings 137, 139 in the tabs 136, 138 are configured to simultaneously engage and secure a vertical rebar rod 120 on a second (i.e., front), opposite side of the rebar cage connector 130. Accordingly, the rebar cage connector 130 is a device used for building a rebar cage 100, a structure used to reinforce concrete. The rebar cage connector 130 may be made of metal, such as hot dipped galvanized spring steel, high carbon steel, or any suitable material, and coated with rust-resistant material to increase its durability and lifespan. In various embodiments, the rebar cage connector 130 may be a single, integrated component. Additionally and/or alternatively, the upper tab 136, lower tab 138, and/or hook portion 133 may be fixedly attached to the base portion 131.

Figure 7:
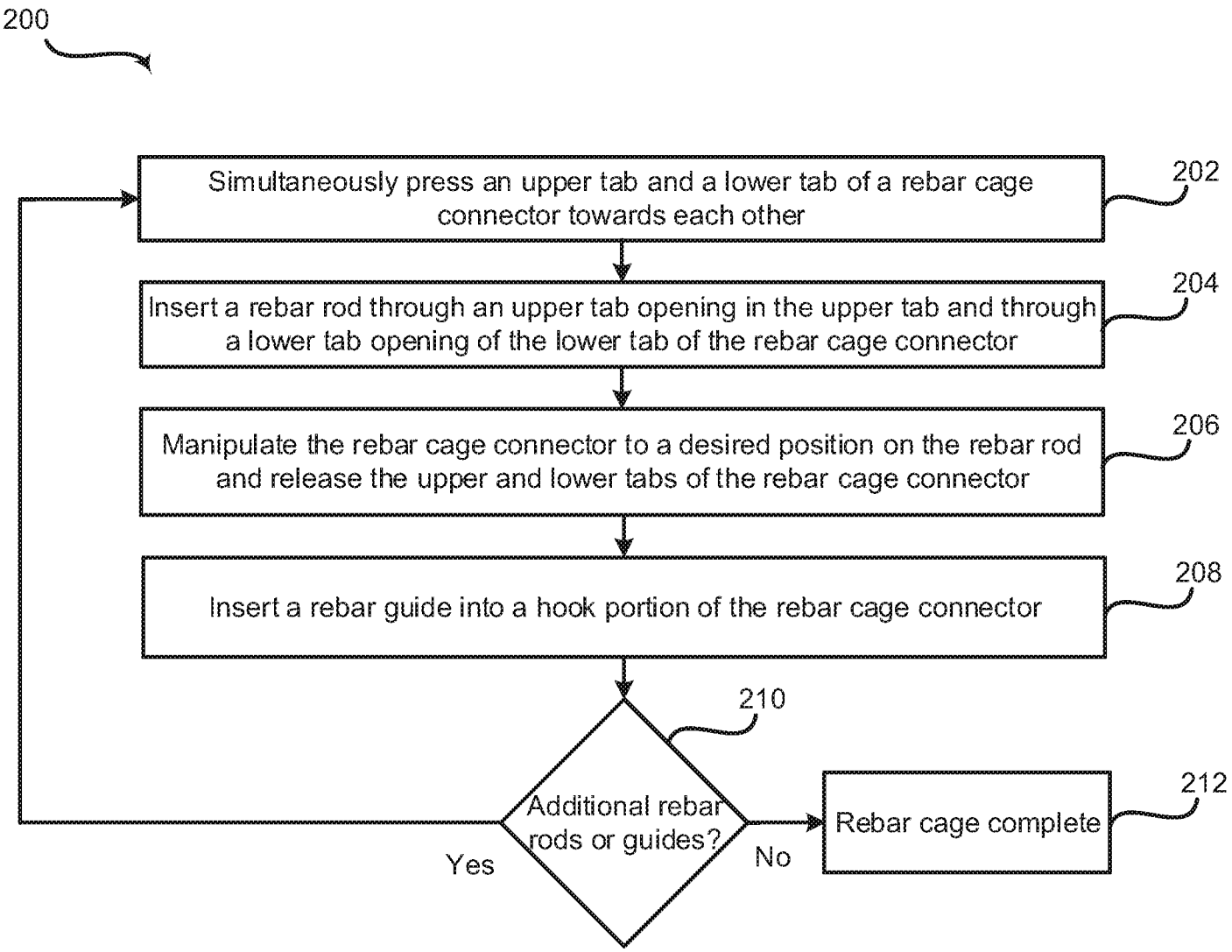
FIG. 7 is a flow chart illustrating exemplary steps that may be utilized for constructing reinforcing bar cages, in accordance with various embodiments.

FIG. 7 is a flow chart 200 illustrating exemplary steps 202-212 that may be utilized for constructing reinforcing bar cages 100, in accordance with various embodiments. Referring to FIG. 7, there is shown a flow chart 200 comprising exemplary steps 202 through 212. Certain embodiments may omit one or more of the steps, and/or perform the steps in a different order than the order listed, and/or combine certain of the steps discussed below. For example, some steps may not be performed in certain embodiments. As a further example, certain steps may be performed in a different temporal order, including simultaneously, than listed below.

At step 202, an upper tab 136 and a lower tab 138 of a rebar cage connector 130 are simultaneously pressed towards each other. For example, a user may place a thumb and finger on rear sides of the upper 136 and lower 138 tabs and provide a compressive force on the upper 136 and lower 138 tabs. The compressive force causes the ends of the tabs 136, 138 to bend towards each other, which enlarges a size of the openings 137, 139 along a longitudinal axis through the openings 137, 139. In various embodiments, a base portion 131 of the rebar cage connector 130 may have a curvature that is decreased and/or straightened when the compressive force is applied to the tabs 136, 138.

At step 204, a rebar rod 120 is inserted through an upper tab opening 137 of the upper tab 136 and a lower tab opening 139 of the lower tab 138 of the rebar cage connector 130. For example, a user may slide the rebar cage connector 130 onto the rebar rod 120 by inserting the rebar rod 120 through the openings 137, 139 in the tabs 136, 138 while applying the compressive force to the tabs 136, 138.

At step 206, the rebar cage connector 130 is manipulated to a desired position on the rebar rod 120, and the upper 136 and lower 138 tabs of the rebar cage connector 130 are released. For example, the rebar cage connector 130 may be slid along a longitudinal axis of the rebar rod 120 to a desired location on the rebar rod 120. The upper 136 and lower 138 tabs are released when the rebar cage connector 130 is at the desired position on the rebar rod 120. The release of the compressive force causes the size of the openings 137, 139 along the longitudinal axis through the openings 137, 139 to decrease. The end portions of the openings 137, 139 at the central locations of the tabs 136, 138 and at the top and bottom end portions of the base portion 131 are configured to engage a deformation pattern 122 on the rebar rod 120 to provide a strong and stable connection once the compressive force is released from the upper 136 and lower 138 tabs. In various embodiments, a bias force provided by the curvature of the base portion 131 increases the force of the engagement between the two end portions of each of the openings 137, 139 and the deformation pattern 122 on the rebar rod 120 to provide the secure connection of the rebar cage connector 130 on the rebar rod 120.

At step 208, a rebar guide 110 is inserted into a hook portion 133 of the rebar cage connector 130. For example, a rebar guide 110 may be pressed between a flared end 135 of the hook portion 133 and the rear side of the base portion 131. The pressure pushes the flared end 135 away from the rear side of the base portion 131 such that the rebar guide 110 passes through the opening between the flared end 135 and the rear side of the base portion 131 and snaps into the hook portion 133. The flared end 135 is biased towards the rear side of the base portion 131 such that the flared end moves back towards the rear side of the base portion 131 once the rebar guide 110 moves through the opening between the flared end 135 and the rear side of the base portion 131 and into the hook portion 133. Punch grips 137 on an inside surface of the hook portion 133 engage a deformation pattern 112 on the rebar guide 110 once the rebar guide 110 enters the hook portion 133 to provide the secure connection between the hook portion 133 of the rebar cage connector 130 and the rebar guide 110.

At step 210, if additional rebar rods 120 or rebar guides 110 are being used to construct the rebar cage 100, steps 202 through 208 are repeated using an additional rebar cage connector 130 for each connection point between the rebar guide(s) 110 and rebar rod(s) 120. For example, if the rebar cage 100 comprises three (3) rebar guides 110 and four (4) rebar rods 120, twelve (12) rebar cage connectors 130 may be implemented to build the rebar cage 100. If no additional rebar rods 120 or rebar guides 110 are being used to construct the rebar cage 100, the process proceeds to step 212 where the rebar cage 100 is complete. Once a rebar cage 100 is complete, it can be placed in a mold. The mold can then be filled with mixed concrete. After the concrete sets, the mold can be removed and a concrete element that contains the reinforcing bar cage 100 remains.

Aspects of the present disclosure provide reinforcing bar cage connectors 130 and methods 200 of constructing reinforcing bar cages 100. A reinforcing bar cage 100 may comprise a reinforcing bar guide 110, a reinforcing bar rod 120, and a reinforcing bar cage connector 130. The reinforcing bar cage connector 130 may comprise a front side, a rear side, a base portion 131, an upper tab 136, a lower tab 138, and a hook portion 133. The base portion 131 comprises a top end and a bottom end. The upper tab 136 extends at a first angle from the top end and towards the front side. The upper tab 136 comprises an upper tab opening 137 extending through the upper tab 136 and through the top end of the base portion 131. The lower tab 138 extends at a second angle from the bottom end and towards the front side. The lower tab 138 comprises a lower tab opening 139 extending through the lower tab 138 and through the bottom end of the base portion 131. The hook portion 133 extends from a first end at the base portion 131 at the rear side and curls up towards the upper tab 136 at a second end. The upper tab opening 137 and the lower tab opening 139 receive the reinforcing bar rod 120 on the front side of the reinforcing bar cage connector 130. The hook portion 133 receives the reinforcing bar guide 110 on the rear side of the reinforcing bar cage connector 130.

In an exemplary embodiment, the reinforcing bar cage 100 comprises a plurality of the reinforcing bar rod 120 and a plurality of the reinforcing bar cage connector 130. Each of the plurality of the reinforcing bar cage connector 130 couples one of the plurality of the reinforcing bar rod 120 to the reinforcing bar guide 110. In a representative embodiment, the reinforcing bar cage 100 comprises a plurality of the reinforcing bar guide 110 and a plurality of the reinforcing bar cage connector 130. Each of the plurality of the reinforcing bar cage connector 130 couples one of the plurality of the reinforcing bar guide 110 to the reinforcing bar rod 120. In various embodiments, the first angle and the second angle are substantially a same angle. In certain embodiments, each of the first angle and the second angle is an obtuse angle. In an exemplary embodiment, the base portion 131 comprises a curvature, and the curvature is convex at the front side and concave at the back side. In a representative embodiment, the second end of the hook portion 133 comprises a flared end 135. In various embodiments, the reinforcing bar guide 110 and the reinforcing bar rod 120 comprises a deformation pattern 112, 122. In certain embodiments, each of the upper tab opening 137 and the lower tab opening 139 comprises a first end and a second end. Each of the first end and the second end of each of the upper tab opening 137 and the lower tab opening 139 is configured to engage with the deformation pattern 122 of the reinforcing bar rod 120. In an exemplary embodiment, an inside surface of the hook portion 133 comprises one or more punch grips 134 configured to engage with the deformation pattern 112 of the reinforcing bar guide 110.

Various embodiments provide a reinforcing bar cage connector 130 comprising a front side, a rear side, a base portion 131, an upper tab 136, a lower tab 138, and a hook portion 133. The base portion 131 comprises a top end and a bottom end. The upper tab 136 extends at a first angle from the top end and towards the front side. The upper tab 136 comprises an upper tab opening 137 extending through the upper tab 136 and through the top end of the base portion 131. The lower tab 138 extends at a second angle from the bottom end and towards the front side. The lower tab 138 comprises a lower tab opening 139 extending through the lower tab 138 and through the bottom end of the base portion 131. The hook portion 133 extends from a first end at the base portion 131 at the rear side and curls up towards the upper tab 136 at a second end.

In a representative embodiment, the first angle and the second angle are substantially a same angle. In various embodiments, each of the first angle and the second angle is an obtuse angle. In certain embodiments, the base portion 131 comprises a curvature, and the curvature is convex at the front side and concave at the back side. In an exemplary embodiment, the second end of the hook portion 133 comprises a flared end 135. In a representative embodiment, an inside surface of the hook portion 133 comprises one or more punch grips 134. In various embodiments, the reinforcing bar cage connector 130 is a single integrated component. In certain embodiments, the reinforcing bar cage connector 130 is made of hot dipped galvanized spring steel. In an exemplary embodiment, the reinforcing bar cage connector 130 is coated with a rust-resistant material.

Certain embodiments provide a method 200 of constructing a reinforcing bar cage 100. The method 200 comprises simultaneously receiving 202 a compressive force at an upper tab 136 and a lower tab 138 of a reinforcing bar cage connector 130. The upper tab 136 extends at a first angle from a top end of a base portion 131 of the reinforcing bar cage connector 130 and towards a front side of the reinforcing bar cage connector 130. The upper tab 136 comprises an upper tab opening 137 extending through the upper tab 136 and through the top end of the base portion 131. The lower tab 138 extends at a second angle from a bottom end of the base portion 131 and towards the front side of the reinforcing bar cage connector 130. The lower tab 138 comprises a lower tab opening 139 extending through the lower tab 138 and through the bottom end of the base portion 131. The method 200 comprises inserting 204 a reinforcing bar rod 120 through the upper tab opening 137 and the lower tab opening 139 of the reinforcing bar cage connector 130. The method 200 comprises manipulating 206 the reinforcing bar cage connector 130 to a desired position on the reinforcing bar rod 120. The method 200 comprises releasing 206 the compressive force from the upper tab 136 and the lower tab 138 of the reinforcing bar cage connector 130. The method 200 comprises inserting 208 a reinforcing bar guide 110 into a hook portion 133 of the reinforcing bar cage connector 130. The hook portion 133 extends from a first end at the base portion 131 at a rear side of the reinforcing bar cage connector 130 and curls up towards the upper tab 136 at a second end.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, a component is "operable" or "configured" to perform a function whenever the component comprises the necessary structure to perform the function, regardless of whether the function is performed.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed.

What is claimed is:

1. A reinforcing bar cage comprising:
a reinforcing bar guide;
a reinforcing bar rod; and
a reinforcing bar cage connector comprising:
a front side;
a rear side;
a base portion having a top end and a bottom end;
an upper tab extending at a first angle from the top end and towards the front side, the upper tab comprising an upper tab opening extending through the upper tab and through the top end of the base portion;
a lower tab extending at a second angle from the bottom end and towards the front side, the lower tab comprising a lower tab opening extending through the lower tab and through the bottom end of the base portion; and
a hook portion extending from a first end at the base portion at the rear side and curling up towards the upper tab at a second end,
wherein:
the upper tab opening and the lower tab opening receive the reinforcing bar rod on the front side of the reinforcing bar cage connector, and
the hook portion receives the reinforcing bar guide on the rear side of the reinforcing bar cage connector.

2. The reinforcing bar cage of claim 1, comprising a plurality of the reinforcing bar rod and a plurality of the reinforcing bar cage connector, wherein each of the plurality of the reinforcing bar cage connector couples one of the plurality of the reinforcing bar rod to the reinforcing bar guide.

3. The reinforcing bar cage of claim 1, comprising a plurality of the reinforcing bar guide and a plurality of the reinforcing bar cage connector, wherein each of the plurality of the reinforcing bar cage connector couples one of the plurality of the reinforcing bar guide to the reinforcing bar rod.

4. The reinforcing bar cage of claim 1, wherein the first angle and the second angle are substantially a same angle.

5. The reinforcing bar cage of claim 1, wherein each of the first angle and the second angle is an obtuse angle.

6. The reinforcing bar cage of claim 1, wherein:
the base portion comprises a curvature; and
the curvature is convex at the front side and concave at the back side.

7. The reinforcing bar cage of claim 1, wherein the second end of the hook portion comprises a flared end.

8. The reinforcing bar cage of claim 1, wherein the reinforcing bar guide and the reinforcing bar rod comprises a deformation pattern.

9. The reinforcing bar cage of claim 8, wherein:
each of the upper tab opening and the lower tab opening comprises a first end and a second end; and
each of the first end and the second end of each of the upper tab opening and the lower tab opening is configured to engage with the deformation pattern of the reinforcing bar rod.

10. The reinforcing bar cage of claim 8, wherein:
the hook portion comprises an inside surface facing an interior of the hook portion, an outside surface facing away from the interior of the hook portion, and lateral sides extending between the first end and the second end, and
the inside surface of the hook portion between the first end and the second end and between the lateral sides comprises one or more dimpled protrusions projecting from the inside surface into the interior of the hook portion, wherein the dimpled protrusions are configured to engage with the deformation pattern of the reinforcing bar guide.

11. A reinforcing bar cage connector comprising:
a front side;
a rear side;
a base portion having a top end and a bottom end;
an upper tab extending at a first angle from the top end and towards the front side, the upper tab comprising an upper tab opening extending through the upper tab and through the top end of the base portion;
a lower tab extending at a second angle from the bottom end and towards the front side, the lower tab comprising a lower tab opening extending through the lower tab and through the bottom end of the base portion; and
a hook portion extending from a first end at the base portion at the rear side and curling up towards the upper tab at a second end.

12. The reinforcing bar cage connector of claim 11, wherein the first angle and the second angle are substantially a same angle.

13. The reinforcing bar cage connector of claim 11, wherein each of the first angle and the second angle is an obtuse angle.

14. The reinforcing bar cage connector of claim 11, wherein:

the base portion comprises a curvature; and the curvature is convex at the front side and concave at the back side.

15. The reinforcing bar cage connector of claim 11, wherein the second end of the hook portion comprises a flared end.

16. The reinforcing bar cage connector of claim 11, wherein:

the hook portion comprises an inside surface facing an interior of the hook portion, an outside surface facing away from the interior of the hook portion, and lateral sides extending between the first end and the second end, and the inside surface of the hook portion between the first end and the second end and between the lateral sides comprises one or more dimpled protrusions projecting into the interior of the hook portion.

17. The reinforcing bar cage connector of claim 11, wherein the reinforcing bar cage connector is a single integrated component.

18. The reinforcing bar cage connector of claim 11, wherein the reinforcing bar cage connector is made of hot dipped galvanized spring steel.

19. The reinforcing bar cage connector of claim 11, wherein the reinforcing bar cage connector is coated with a rust-resistant material.

20. A method of constructing a reinforcing bar cage, the method comprising:

simultaneously receiving a compressive force at an upper tab and a lower tab of a reinforcing bar cage connector, wherein:

the upper tab extends at a first angle from a top end of a base portion of the reinforcing bar cage connector and towards a front side of the reinforcing bar cage connector;

the upper tab comprises an upper tab opening extending through the upper tab and through the top end of the base portion;

the lower tab extends at a second angle from a bottom end of the base portion and towards the front side of the reinforcing bar cage connector; and the lower tab comprises a lower tab opening extending through the lower tab and through the bottom end of the base portion;

inserting a reinforcing bar rod through the upper tab opening and the lower tab opening of the reinforcing bar cage connector;

manipulating the reinforcing bar cage connector to a desired position on the reinforcing bar rod;

releasing the compressive force from the upper tab and the lower tab of the reinforcing bar cage connector; and inserting a reinforcing bar guide into a hook portion of the reinforcing bar cage connector, wherein the hook portion extends from a first end at the base portion at a rear side of the reinforcing bar cage connector and curls up towards the upper tab at a second end.

* * * * *